US006217490B1

(12) United States Patent
Wurtak

(10) Patent No.: US 6,217,490 B1
(45) Date of Patent: Apr. 17, 2001

(54) MARTIAL ARTS EQUIPMENT DEVICE

(76) Inventor: Gerry Wurtak, 3410-4th Avenue N., Regina, Saskatchewan (CA), S4R 0V9

( * ) Notice: Subject to any disclaimer, the term of this patent is extended or adjusted under 35 U.S.C. 154(b) by 0 days.

(21) Appl. No.: 09/332,119

(22) Filed: Jun. 14, 1999

Related U.S. Application Data

(60) Provisional application No. 60/089,269, filed on Jun. 15, 1998.

(51) Int. Cl.[7] ..... A63B 21/00; A47C 1/10

(52) U.S. Cl. ..... 482/83; 482/84; 248/316.4

(58) Field of Search ..... 482/83, 87, 90, 482/908; 248/316.4, 201, 274, 309.1, 125; 21/41, 89

(56) References Cited

U.S. PATENT DOCUMENTS 4,757,989 * 7/1988 Bauer, Jr. ..... 482/83
4,973,045 * 11/1990 Heberer ..... 482/83
5,415,371 * 5/1995 Kirchner ..... 482/83
5,458,551 * 10/1995 Shenton ..... 482/83

* cited by examiner

*Primary Examiner*—Jerome W. Donnelly
(74) *Attorney, Agent, or Firm*—Adrian D. Battison

(57) ABSTRACT

A martial arts equipment device for supporting boards in vertical orientation for breaking comprises a frame having a horizontal base for resting on the ground and a pair of vertical posts upstanding from the base and collapsible inclined rear posts which support the vertical posts. The inclined posts and the vertical posts can be folded down for collapsing of the frame for storage. The boards are carried in a pair of fixed arms and a pair of hinged arms in front of the vertical posts with the arms having slide portions to pinch the top and bottom of the boards. A rear abutment prevents the boards from moving rearwardly when impacted in the breaking action. The device is adjustable for height and for the number of boards supported.

4 Claims, 4 Drawing Sheets

MARTIAL ARTS EQUIPMENT DEVICE

This application claim benefit to Provisional Application 60/089,269 filed Jun. 15, 1998.

This invention relates to an apparatus for supporting boards for use in martial arts demonstrations.

BACKGROUND OF THE INVENTION

One of the features of martial arts is the breaking of boards. This can be done in practice and also is carried out in exhibition and in competition. The boards have to be supported effectively so that the breaking is effected cleanly. In particular, holding the boards in vertical orientation requires a device which supports the boards so that they are supported against falling and against recoil.

SUMMARY OF THE INVENTION

It is one object of the present invention is a device that holds the boards safely in a position that is appropriate for people of different sizes and height.

According to one aspect of the invention there is provided a martial arts equipment device comprises;

a frame;

the frame having a horizontal base for resting on the ground and a pair of vertical posts upstanding from the base;

the vertical posts having a slidable member;

the slidable member being arranged for holding one or more parallel boards being placed side by side in a vertical orientation for breaking;

wherein the frame includes a collapsible inclined rear posts which supports the vertical posts;

the collapsible inclined rear posts being mounted on a hinge;

the hinge being located on the horizontal base arranged to support the collapsible inclined rear post;

the vertical post being collapsible and mounted on a second hinge;

the second hinge being located on the horizontal base for supporting the vertical post.

Preferably the frame includes a wheel for movement across the ground.

Preferably the frame includes a plurality of cross bars to support the vertical post, the horizontal base and the collapsible inclined rear post, the cross bars being mounted on the vertical post, the horizontal base and the collapsible inclined rear post such that the cross bars are perpendicular to the vertical post, the horizontal base and the collapsible inclined rear post.

According to a second aspect of the invention there is provided a martial arts equipment device comprising;

a frame;

the frame having a horizontal base for resting on the ground and a pair of vertical posts upstanding from the base;

the vertical posts having a slidable member;

the slidable member being arranged for holding one or more parallel boards placed side by side in a vertical orientation for breaking;

wherein the slideable member has a member for supporting one or more parallel boards placed side by side in a vertical orientation for breaking;

the member for supporting one or more boards having a pair of pivotal arms which hold the boards in position;

the pivotal arms having an extending member to allow one or more boards to be supported;

the member for supporting one or more boards having a pair of rigid support arms with hold the boards in position;

the rigid arms having an extending member to allow one or more board to be supported;

the rigid arms co-operating with the pivotal arms to clasp the boards;

an abutment being fixed to the slidable member and positioned to break the boards;

the abutment being located below the pivotal arms for increased support.

Preferably the extending members have a cross member in which forms a lip that is formed to hold the boards in position;

Preferably the extending members are spring mounted to allow one or more boards to be placed on the slidable member;

Preferably the pivotal arms are mounted on a hinge in which is located on the slidable member so that the pivotal arms can be adjusted to allow boards to be inserted onto the rigid arms and held by the pivotal support arms.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
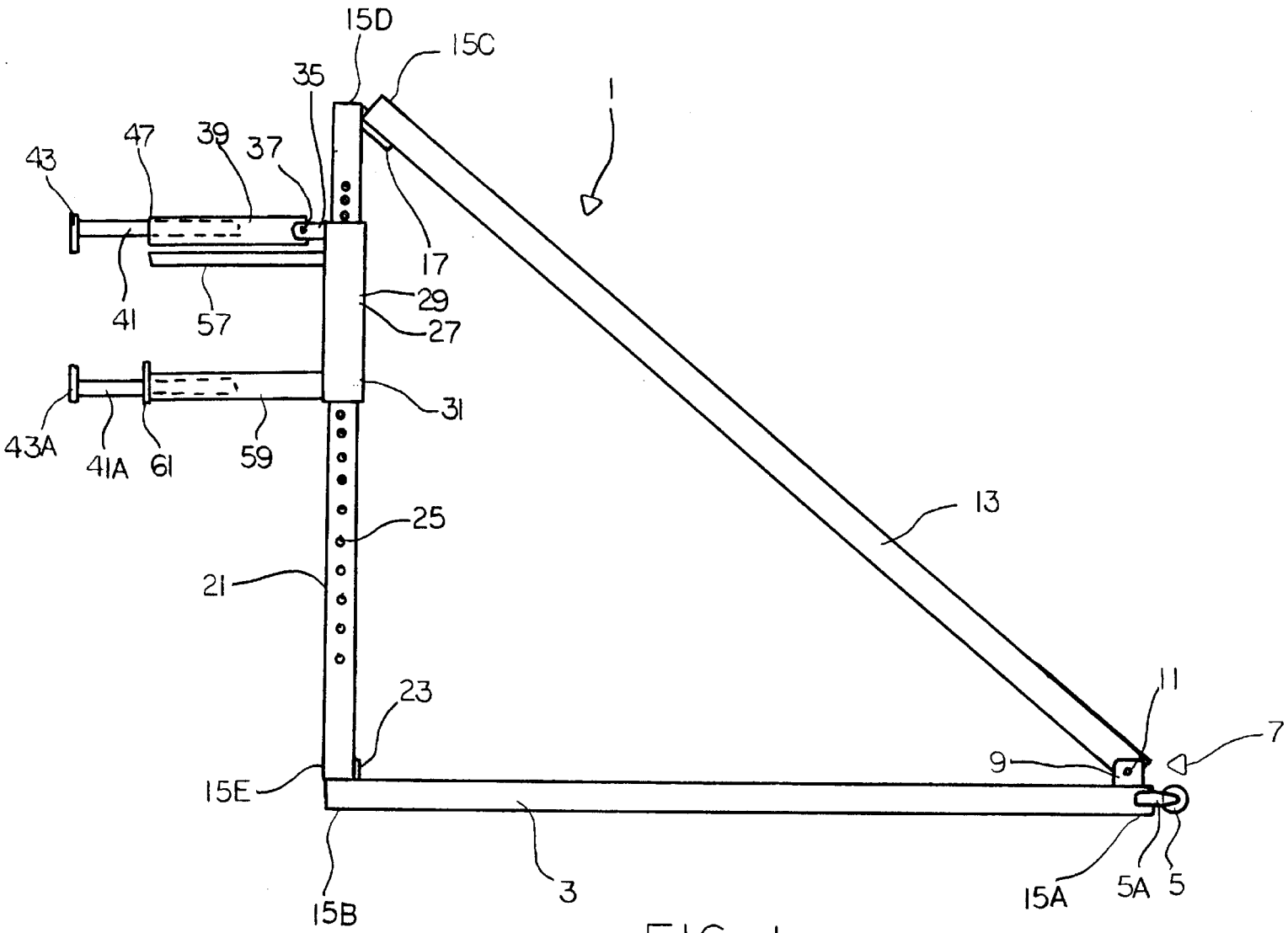
FIG. 1 is side elevational view of the present invention.
Figure 2:
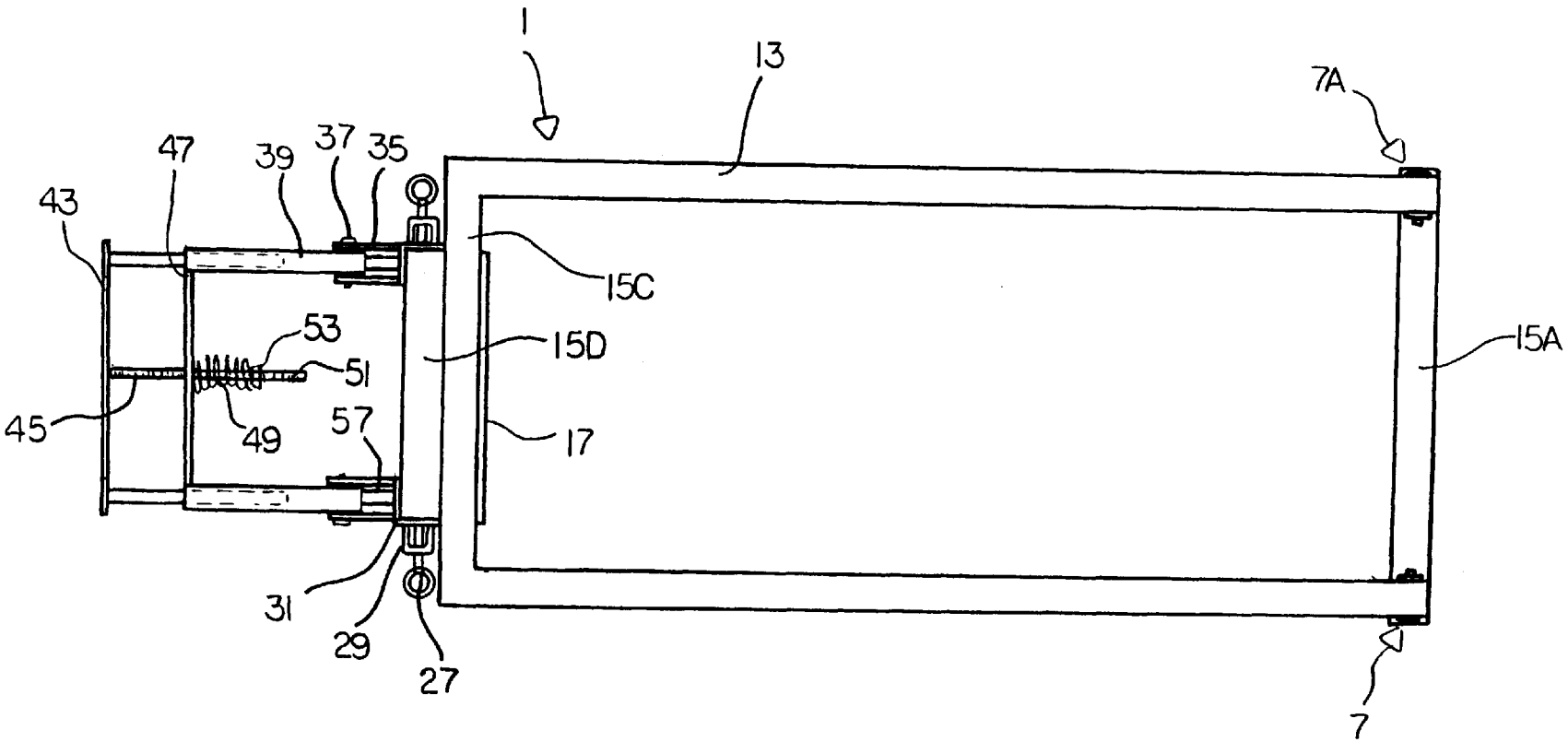
FIG. 2 is a top plan view of the present invention.
Figure 3:
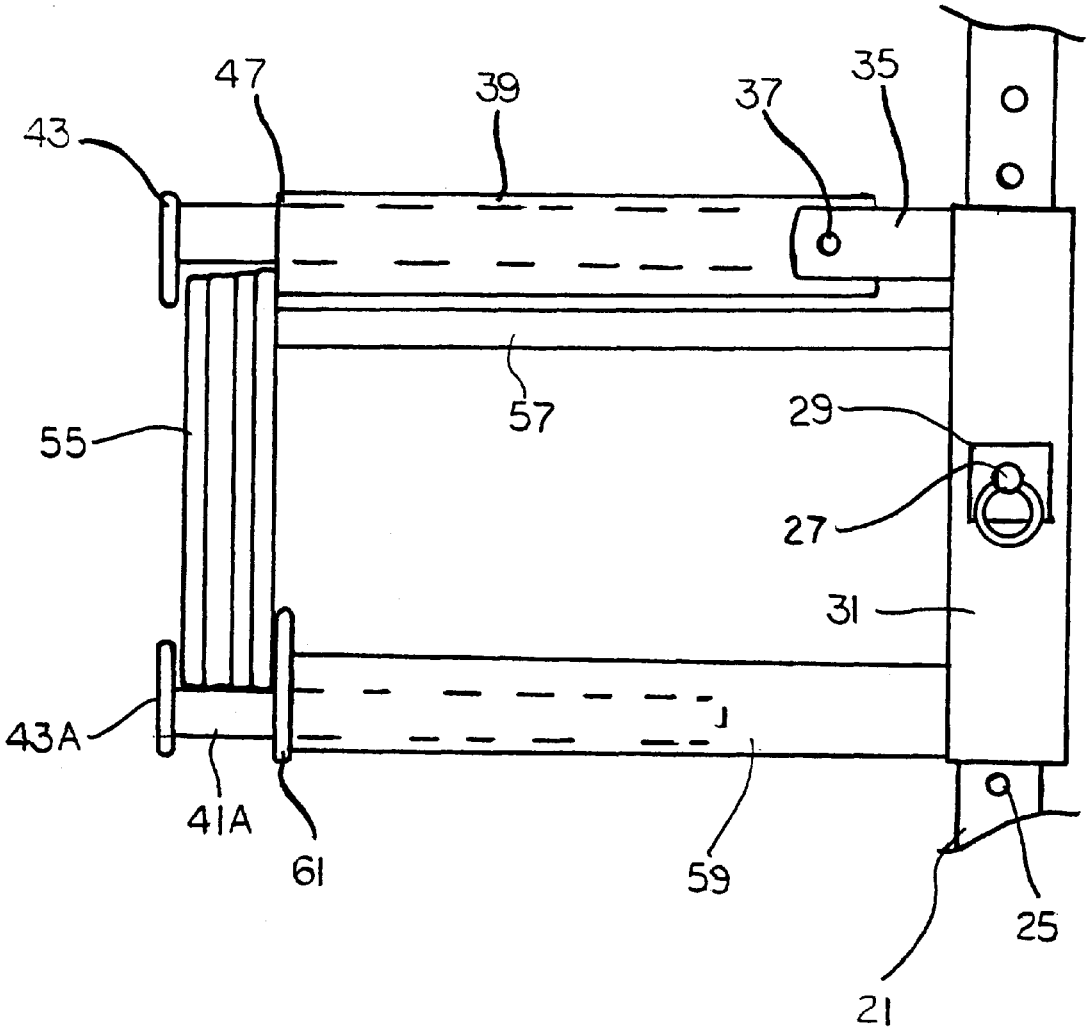
FIG. 3 is a partial side view of the present invention.
Figure 4:
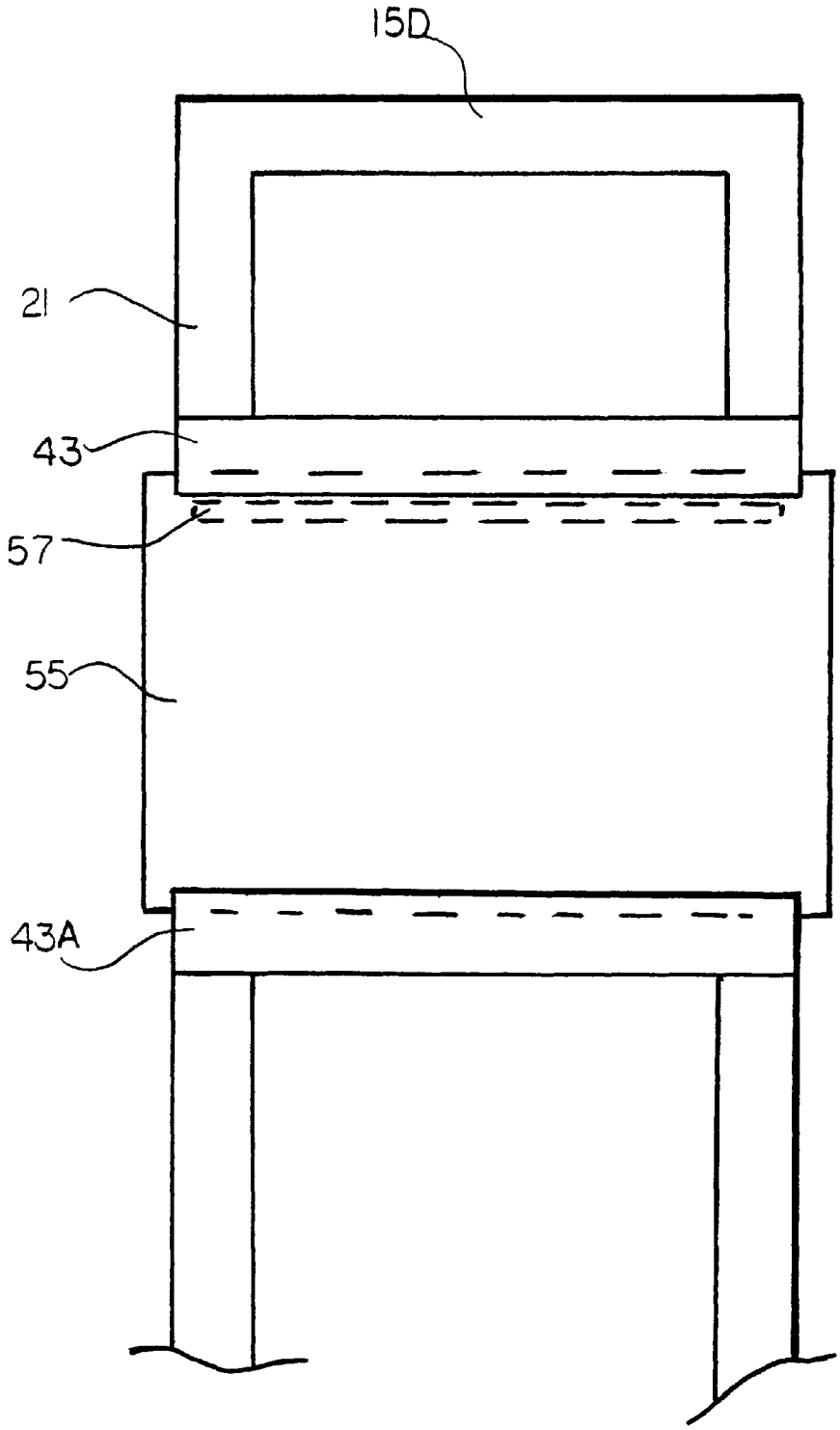
FIG. 4 is a partial front view of the present invention.

A martial arts board breaking device 1 has two parallel main base arms 3 which are positioned on the ground for supporting the device 1. The base arms are square hollow steel tubes. Located at the rear most end of the base arms 3 are two wheels 5 for movement across the ground and a first cross bar 15A. The cross bars are square hollow steel tubes. The wheels 5 are held by wheel arms 5A. A second cross bar 15B is located at the front end of the base 3 and is parallel to the first cross bar 15A.

Located on the top portion of the rear most end of the base 3 are two pivots 7 and 7A. The pivot 7 consists of two side plates 9 in which a pin 11 is inserted through. Fixed between the pivot mounts 9 are two parallel support arms 13. The support arms are square hollow steel tubes.

The parallel support arms 13 extend forwardly and upwardly at an angle of approximately 40°. The top end of the parallel support arms 13 is a third cross bar 15C, extending parallel to the first cross bar 15A and the second cross bar 15B, is held by a bracket 17. The support section 19 is able to fold at the pivot 7 when the top end is separated from the bracket 17 for compact storage.

The bracket 17 is mounted a fourth parallel cross bar 15D on the top end of two parallel front arms 21. The front arms are square hollow steel tubes. The front arms 21 are mounted on a hinge 23 which is held by the base arms 3. The front arms 21 extend upward at right angles from the base arms 3 to the support arms 13. At the bottom end of the front arms 21 is a fifth parallel cross bar 15E in which the hinge 23 is mounted.

The front arms 21 can be folded down for compact storage.

When the base arms 3, the support arms 13 and the front arms 21 are in position they form a right angled triangle.

On the outer sides of the front arms are adjustment hole 25 in which two pins 27 are inserted. The pins 27 are inserted through two locks 29 which in turn hold an pair of adjustable slide sleeve 31. Each sleeve 31 is a square hollow steel tube which is of sufficient size to be able to freely slide upwardly and downwardly on the front arms 21.

Extending parallel in a forward direction from either side of the top end of the sleeve 31 are two pairs of pivotal arms 35. Each pair of pivotal arms 35 has a pivot pin 37 which in then holds a pivotal board support arm 39. The pivotal board support arm 39 extends perpendicularly in a forward direction from the front arms 21. The pivotal board support arms are square hollow steel tubes. A plate 47 extends horizontally to fix to the opposite pivotal support arm. Inserted into the pivotal board support arm 39 is a protruding arm 41 which is of significant size so that the protruding arm 41 can freely slide forward and back in the pivotal board support arm 39. The protruding arms are square hollow steel tubes.

The protruding arms 41 have a front plate 43 which extends horizontally to fix to the opposite protruding arm 41. Mounted directly in the center of the front plate is a plate adjusting bar 45. The bar 45 extends rearwardly through the plate 47 and is surrounded by a spring 49. At the rear end of the bar is a threaded portion 51 in which a nut 53 is screwed on which holds the protruding arm 41 in position.

In order to ensure that the board 55 is secure a board stop 57 is fixed in a parallel position to the pivotal arm 39 and attached to the adjustable slide sleeve 31.

Extending parallel in a forward direction from either side of the bottom end of the sleeve 31 are two pairs of main board support arms 59. The main board support arms 59 are welded in a fixed position parallel to the pivotal arm 39. The main support arms 59 are square hollow steel tubes. At the forward end of the mains support arms is a back plate 61 which extends horizontally to the opposite arm 59 in order to create support when the board 55 is struck.

Inserted into the main support arm 59 is a second protruding arm 41A which is of significant size so that the protruding arm 41A can freely slide forward and back in the main board support arm 59. The protruding arms are square hollow steel tubes.

The second protruding arms 41A have a front plate 43A which extends horizontally to fix to the opposite second protruding arm 41A. Mounted directly in the center of the front plate is a second plate adjusting bar 45A. The second bar 45A extends rearwardly through the plate 47A and is surrounded by a second spring 49A. At the rear end of the bar is a second threaded portion 51A in which a second nut 53A is screwed on which holds the protruding arm 41 in position.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. Apparatus for holding boards for breaking in martial arts comprising;

a frame;

the frame having a horizontal base for resting on the ground and an upstanding support structure carried on the base;

the support structure having a support member which is vertically slidable thereon for adjusting the height thereof;

the support member being arranged for holding a plurality of side by side parallel boards placed in a vertical orientation for breaking and including:

a rigid support portion for engaging and holding one edge of the boards and including an extending clamp for clamping the edge, the rigid support portion extending forwardly from the support member so as to hold the boards in front of the support member;

a pivotal support portion for engaging and holding an edge of the boards which is opposite to said one edge and including an extending clamp for clamping the edge, the pivotal support portion extending forwardly from the support member so as to hold the boards in front of the support member;

the pivotal support portion being mounted on the support member for pivotal movement toward and away from the rigid support so that the pivotal support co-operates with the rigid support portion to clasp the boards therebetween;

and an abutment fixed to the support member and extending forwardly therefrom to a position adjacent the pivotal support portion such that the boards are broken between the fixed support portion and the abutment while allowing pivotal movement of the pivotal support portion away from the fixed support portion.

2. The apparatus according to claim 1 wherein the extending clamp of each of the pivotal support portion and the rigid support portion has a cross member which forms a lip that is formed to hold the boards in position.

3. The apparatus according to claim 1 wherein the extending clamp of each of the pivotal support portion and the rigid support portion is spring biased in a direction to clamp the boards.

4. The apparatus according to claim 1 wherein the pivotal support portion includes a pair of transversely spaced parallel arms and the fixed support portion includes a pair of transversely spaced parallel arms.

* * * * *